United States Patent [19]

Goldbach

[11] Patent Number: 4,605,013

[45] Date of Patent: Aug. 12, 1986

[54] METHOD AND APPARATUS FOR FORMING DISCRETE BATCHES OF TOBACCO PARTICLES

[75] Inventor: Manfred Goldbach, Hamburg, Fed. Rep. of Germany

[73] Assignee: Hauni-Werke Körber & Co. KG, Hamburg, Fed. Rep. of Germany

[21] Appl. No.: 575,169

[22] Filed: Jan. 30, 1984

[30] Foreign Application Priority Data

Feb. 2, 1983 [DE] Fed. Rep. of Germany ..... 3303381

[51] Int. Cl.[4] ..... A24C 5/14

[52] U.S. Cl. ..... 131/80; 131/108; 131/84.1; 131/77

[58] Field of Search ..... 131/77, 78, 79, 80, 131/81 R, 81 A, 82, 84 B, 108, 109 R, 82.1, 82.2, 81.3, 8.4

[56] References Cited

U.S. PATENT DOCUMENTS 3,996,943 12/1976 Hinzmann ..... 131/109 R 3,996,944 12/1976 Hinzmann ..... 131/109 R 4,235,248 11/1980 Schumacher ..... 131/108

*Primary Examiner*—V. Millin

*Attorney, Agent, or Firm*—Peter K. Kontler

[57] ABSTRACT

Circumferentially extending recesses in the peripheral surface of a rotating suction wheel are filled with tobacco shreds which are delivered in the form of a narrow stream by a pneumatic conveyor having a narrow tobacco propelling channel extending radially of the suction wheel and receiving the shreds of the stream in a current of compressed air. The surplus of shreds is removed by the current and/or by a trimming device which is installed in the interior of the pneumatic conveyor, and such surplus is recirculated through the distributor of a cigarette rod making machine and back into the pneumatic conveyor. The batches are used to form the interrupted core of a composite tobacco filler wherein the core is surrounded by a tubular envelope containing a different blend of tobacco.

20 Claims, 5 Drawing Figures

METHOD AND APPARATUS FOR FORMING DISCRETE BATCHES OF TOBACCO PARTICLES

CROSS REFERENCE TO RELATED CASE

A machine which can process batches of tobacco particles of the type formed in accordance with the method and in the apparatus of the present invention is disclosed in commonly owned copending patent application Ser. No. 572,560 filed Jan. 18, 1984 by Günter Wahle et al. for "Method and apparatus for producing a composite tobacco filler".

BACKGROUND OF THE INVENTION

The present invention relates to a method and apparatus for forming discrete batches of tobacco particles, especially for forming elongated sections of an interrupted tobacco stream. More specifically, the invention relates to improvements in a method of and in an apparatus for forming discrete batches of tobacco particles at the periphery of a rotary conveyor, especially a rotary suction wheel.

Tobacco batches which can be formed in accordance with the method of and in the apparatus of the present invention can be utilized to form an interrupted tobacco stream, especially the interrupted core of a composite tobacco filler wherein the core is surrounded by a tubular envelope or shell consisting of a different fibrous material. Such composite fillers can be used for the making of cigarettes, cigarillos, cigars or other rod-shaped articles of the tobacco processing industry.

It is already known to make the fillers of rod-shaped smokers' articles (hereinafter referred to as cigarettes for the sake of simplicity) from several types of natural, substitute or reconstituted tobacco. For example, the core of the composite filler can consist of tobacco particles whose color is different from the color of particles which form the tubular envelope. Alternatively, the core can be made of so-called discard tobacco, namely short tobacco which is removed as surplus from a fully grown tobacco stream and is returned into the distributor of a cigarette rod making machine for reintroduction into the tobacco stream building unit. A drawback of presently known methods and apparatus for the making of such composite tobacco fillers is that they cannot ensure the formation of a satisfactory composite filler at the speed which is required in a modern high-speed cigarette maker, e.g., a cigarette rod making machine of the type known as PROTOS (manufactured and sold by the assignee of the present application) which can turn out up to and well in excess of 8000 plain cigarettes per minute. Moreover, all presently known methods and apparatus for the making of a composite tobacco filler are uneconomical and the quality of the filler is far from satisfactory because the core is not located at the center of the filler, the density of the core is too low and/or the material of the core can be seen at one or both axial ends of each plain cigarette which embodies a portion of such composite filler. A main drawback of presently known apparatus for the making of a composite filler of tobacco particles is that the density of the batches which constitute the core of the composite filler is too low. This is due to the fact that the intervals for accumulation of tobacco shreds into discrete batches of tobacco particles are very short. Thus, if the batches are formed in the peripheral pockets of a rotary wheel-shaped conveyor, satisfactory filling of the pockets in accordance with heretofore known proposals is possible only if the speed of the conveyor is relatively low so that the batches cannot be formed at the rate which is required to form a core for use in a composite filler which is immediately processed in a high-speed maker of cigarettes, cigarillos or like smokers' products.

OBJECTS AND SUMMARY OF THE INVENTION

An object of the invention is to provide a novel and improved method of accumulating batches of tobacco particles at a high frequency and in such a way that the density of each batch matches or closely approximates an optimum value.

Another object of the invention is to provide a method which ensures the making of satisfactory sections of an elongated interrupted stream of tobacco particles even if the stream is formed at the rate which is required in a modern high-speed cigarette maker serving to turn out well in excess of 100 rod-shaped articles per second.

A further object of the invention is to provide a method which can be practiced with advantage to fill successive pockets at the periphery of a rotary drum-shaped suction conveyor in such a way that each pocket is filled to the same extent so that the density of the batch in each pocket matches the required density.

An additional object of the invention is to provide a novel and improved apparatus which can be utilized for the practice of the above outlined method and to construct the apparatus in such a way that it can turn out high-quality batches of compacted tobacco particles at a surprisingly high frequency as well as that each batch exhibits the same length and the same cross-sectional area.

A further object of the invention is to provide the apparatus with novel and improved means for supplying particles of tobacco to the pockets which are machined into or otherwise formed in the periphery of a rotary drum-shaped suction conveyor.

An ancillary object of the invention is to provide a novel and improved arrangement for removing the surplus of tobacco particles from the periphery of the suction wheel.

Another object of the invention is to provide an apparatus of the above outlined character which can be installed in conventional cigarette rod making machines to facilitate the making of composite fillers for draping into webs of cigarette paper or the like.

One feature of the invention resides in the provision of a method of forming discrete batches of tobacco particles at the periphery of a rotating conveyor, particularly in the circumferentially extending recesses which are machined into or otherwise formed in the peripheral surface of a rotary wheel- or drum-shaped suction conveyor. The method comprises the steps of converting the particles of tobacco into a relatively wide first stream and forcibly advancing the first stream along the first portion of a predetermined path, converting the first stream into a narrower second stream and forcibly advancing the second stream along a second portion of the path, and conveying successive increments of the second stream toward the periphery and substantially radially of the rotating conveyor. At least one of the advancing steps preferably comprises pneumatically transporting the respective stream along the respective portion of the path. The conveying step preferably includes propelling successive increments of the second stream into successive recesses of the conveyor so that each recess is at least nearly filled with tobacco particles and its shape determines the configuration of the respective batch. The propelling step can include overfilling the recesses of the rotary conveyor with tobacco particles so that at least the majority of freshly formed batches contain a surplus of tobacco particles. At least one portion of the predetermined path (e.g., the second portion) has an arcuate shape.

At least the second advancing step preferably includes introducing the particles of tobacco into a current of air, and such method preferably further comprises the step of conveying the current of air past and beyond the location of impingement of successive increments of the second stream upon the conveyor. The second advancing step can include delivering particles of tobacco in excess of the requirements of successive batches, and the method then further comprises the step of removing the excess in the current of air.

If at least some of the batches contain a surplus of tobacco particles, the method preferably further comprises the steps of removing the surplus from the corresponding batches and reintroducing the removed surplus into the current of air.

Another feature of the invention resides in the provision of an apparatus for forming discrete batches of tobacco particles. The apparatus comprises a rotary conveyor having a peripheral surface provided with recesses or pockets for tobacco particles, and means for delivering tobacco particles to the conveyor including a tubular second conveyor having a particle-guiding wall which extends substantially radially and toward the peripheral surface of the rotary conveyor. The wall of the second conveyor preferably includes a portion which is adjacent to the rotary conveyor and defines a U-shaped channel for a relatively narrow stream of tobacco particles. The width of the channel preferably equals or approximates the width of the recesses in the peripheral surface of the rotary conveyor. The second conveyor preferably further comprises an arcuate portion which is disposed opposite the particle-guiding wall, and a portion of the rotary conveyor preferably extends into the second conveyor in the general area of arcuate portion of the second conveyor. A portion of the second conveyor preferably extends beyond the particle-guiding wall and along a portion of the peripheral surface of the rotary conveyor.

As a rule, the second conveyor is arranged to deliver tobacco particles with a surplus so that at least some of the batches which are formed in the recesses of the rotary conveyor as a result of admission of tobacco particles thereinto contain excess tobacco. Such apparatus preferably further comprises means for removing the excess from the respective batches, and such excess removing means is preferably installed in the interior of the second conveyor. The recesses of the rotary conveyor preferably surround a stationary suction chamber, and the rotary conveyor is then provided with ports which connect the suction chamber with certain recesses, namely, with recesses which are provided in a predetermined portion of the peripheral surface of the rotary conveyor in each angular position of such conveyor.

The aforementioned wall of the second conveyor is preferably formed with an edge face which is adjacent to the peripheral surface of the rotary conveyor, and the tobacco delivering means preferably further comprises means for admitting into the second conveyor a current of compressed air in a direction to propel the particles of tobacco beyond the edge face of the aforementioned wall and into successive recesses of the rotary conveyor. The rotary conveyor preferably extends into an enlarged intermediate portion of the second conveyor. A further conveyor which cooperates with a suction chamber can be provided to receive and/or to remove batches of tobacco particles from successive recesses of the rotary conveyor. If the recesses of the rotary conveyor are overfilled with tobacco particles, the excess is removed by the aforementioned removing means and the thus removed excess is preferably recirculated into the second conveyor, e.g., by way of the distributor of a cigarette rod making machine.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
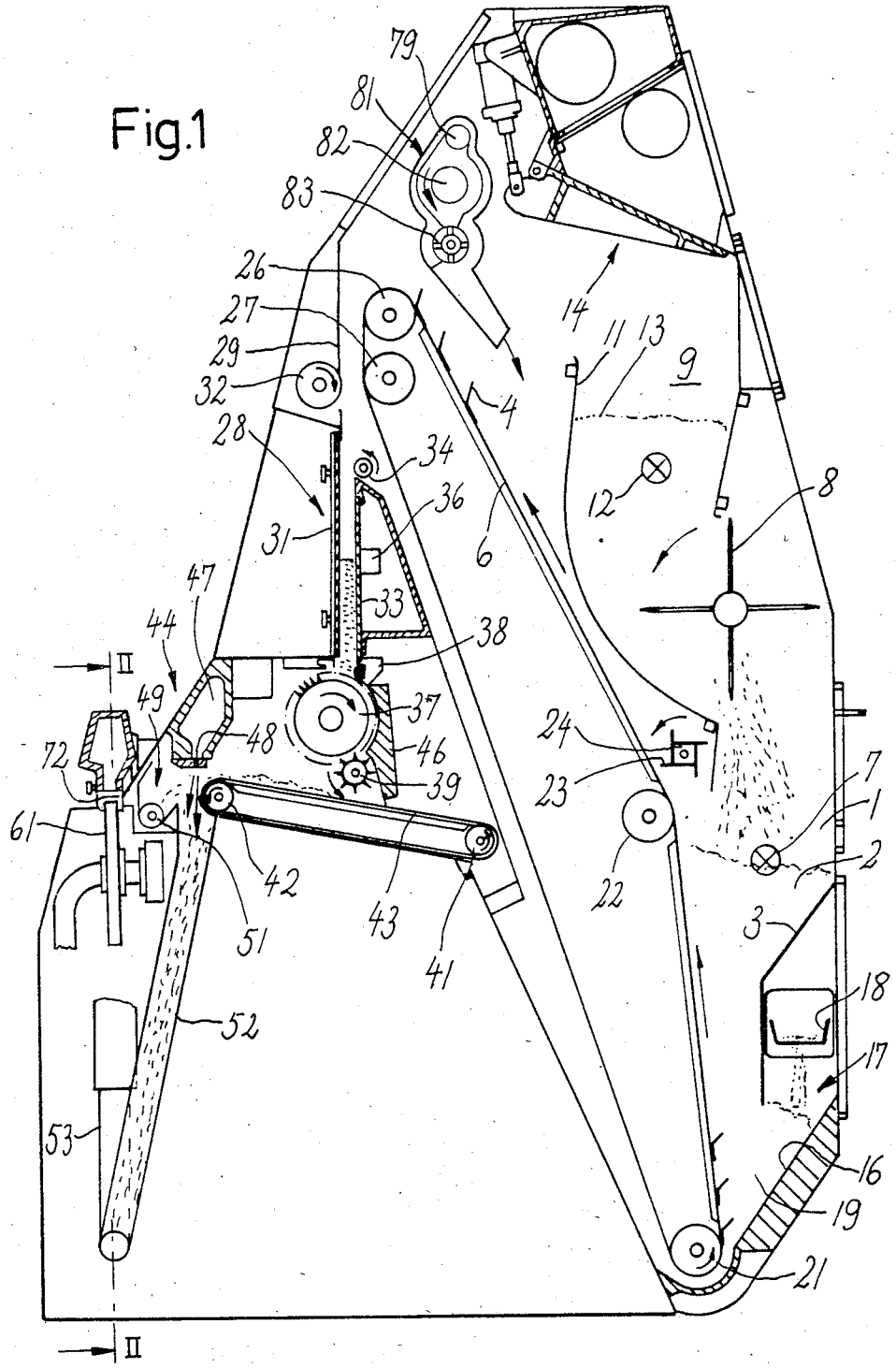
FIG. 1 is a somewhat schematic longitudinal vertical sectional view of a portion of a cigarette rod making machine which embodies the improved apparatus.

FIG. 1 shows the distributor of a cigarette rod making machine, e.g., a machine known as PROTOS which is manufactured and sold by the assignee of the present application. The distributor comprises a first magazine 1 which contains a supply 2 of tobacco particles, primarily shredded tobacco leaf laminae. One side of the magazine 1 is bounded by a downwardly sloping wall 3 and the opposite side of this magazine is bounded by the upwardly moving reach of an endless belt conveyor 6 which carries a series of equidistant tobacco receiving pockets 4. The mutual inclination of the right-hand reach of the conveyor 6 and of the wall 3 is such that the supply 2 of tobacco particles can readily slide along the wall 3 toward and into the lowermost portion of the magazine 1 but that the particles of tobacco in this magazine are not unduly agitated (e.g., circulated as a result of upward movement of successive pockets 4 therealong). The means for monitoring the height of the column of tobacco particles in the magazine 1 comprises a photocell 7 which transmits signals to the drive of a rotor 8 whose vanes can transfer relatively large batches of tobacco particles from a second magazine 9 which is mounted in the frame of the distributor at a level above the magazine 1. The magazine 9 is separated from the upwardly advancing reach of the conveyor 6 by an arcuate wall 11. The supply 13 of tobacco particles in the magazine 9 is monitored by a second photocell 12 which transmits signals to a gate 14 serving to intermittently permit a large pile of tobacco particles to descend from the outlet of a pneumatic conveyor serving to transport tobacco shreds from a tobacco comminuting machine, not shown. The aforementioned wall 3 is disposed at a level above a third magazine 17 which is bounded in part by the lowermost section of the upwardly moving reach of the conveyor 6 and in part by an additional downwardly sloping wall 16. The magazine 17 receives discard or surplus tobacco 19 from a conveyor 18 which, in turn, receives discard tobacco from the trimming device for a composite tobacco stream which is formed in accordance with a feature of the present invention, namely, which contains a filler consisting of a file of discrete batches of tobacco particles.

The conveyor 6 is trained over four pulleys 21, 22, 26 and 27. The pockets 4 of this conveyor withdraw a certain amount of discard tobacco 19 during travel from the pulley 21 toward the pulley 22, and the remaining portions of successive upwardly moving pockets 4 are thereupon filled with particles of tobacco forming the supply 2 in the magazine 1. A paddle wheel 24 whose paddles constitute straps 23 of leather or the like is located at a level slightly above the pulley 22 and serves to brush away the surplus of tobacco particles so that all of the pockets 4 are filled to the same extent (or substantially to the same extent) when they reach the pulley 26 at the upper end turn of the conveyor 6. The pulley 26 cooperates with the pulley 27 to define a substantially vertical portion of the downwardly moving reach of the conveyor 6, and such portion of the downwardly moving reach is parallel or nearly parallel to a vertical guide wall 29 which directs successive batches of tobacco particles into a vertical duct 28. The pulley 21 is driven by a variable-speed prime mover or transmission (not shown). The guide wall 29 is in line with the left-hand sidewall 31 of the duct 28, and the sidewall 31 is spaced apart from and parallel to a right-hand sidewall or rear wall 33 of the duct 28. The sidewall 33 carries a monitoring device 36 which regulates the speed of the prime mover or transmission for the pulley 21 in dependency on variations of the level of the upper surface of the column of tobacco particles in the duct 28. The monitoring device 36 preferably comprises a battery of electrically interconnected photocells which extend transversely of the sidewall 33 at different levels and preferably transmit signals by way of suitable time-delay units only when they are fully buried in the supply of tobacco particles in the duct 28 for preselected intervals of time. Reference may be had to commonly owned U.S. Pat. No. 4,235,248 granted Nov. 25, 1980 to Peter Schumacher and to commonly owned U.S. Pat. No. 3,903,901 granted Sept. 3, 1975 to Waldemar Wochnowski. The guide wall 29 cooperates with the adjacent portion of the downwardly moving reach of the conveyor 6 to ensure that successive batches of tobacco particles, which are discharged by the pockets 4 arriving at the upper end of the conveyor 6, are compelled to enter the duct 28. The guide wall 29 has a window for a portion of a constantly driven magnetic roller 32 serving to withdraw fragments of metal (if any) from the particulate material which is about to enter the duct 28. The upper end portion of the rear wall 33 of the duct 28 is disposed below a roller 34 which is driven at a constant speed and prevents the accumulation of tobacco shreds on top of the wall 33 when the distributor is in actual use.

The lower end of the duct 28 is open and is disposed at the one o'clock position of a continuously driven carded drum-shaped conveyor 37 which draws a continuous layer of tobacco particles from the column of such particles in the duct 28 and transports the particles into the range of a rapidly driven picker roller 39. The carding of the conveyor 37 is uniformly filled with tobacco particles due to the provision of a homogenizing device 38 which includes a strip-shaped member extending in parallelism with the axis of the conveyor 37 and having a profiled portion extending into the supply of tobacco particles between the conveyor 37 and the rear wall 33 of the duct 28. The manner in which the homogenizing device 38 enhances the filling of the carding of the conveyor 37 with particles of tobacco is fully disclosed in commonly owned U.S. Pat. Nos. 3,996,943 and 3,996,944 granted Dec. 14, 1976 to Alfred Hinzmann. The disclosures of these patents, as well as all other patents mentioned in this specification, are incorporated herein by reference. The picker roller 39 is disposed at the five o'clock position of the carded conveyor 37 and serves to propel particles of tobacco from the carding and onto a relatively wide endless belt conveyor 43 which is trained over pulleys 41 and 42. A stationary shroud 46 overlies a portion of the periphery of the carded conveyor 37 as well as a portion of the picker roller 39; its purpose is to prevent tobacco particles from leaving the carding of the conveyor 37 ahead of the picker roller 39 as well as to prevent the picker roller from propelling particles of tobacco rearwardly toward and beyond the rear pulley 41 for the belt conveyor 43. The conveyor 37 is driven at a variable speed by a transmission (not shown) which receives motion from the main prime mover of the cigarette rod making machine. The conveyor 43 is driven at a constant speed, and its upper reach accumulates a relatively wide carpet of tobacco particles. The leader of such carpet is propelled beyond the front pulley 42 and against a substantially vertical curtain of air jets issuing from a row of closely adjacent square orifices 48 in the bottom wall of a plenum chamber 47 forming part of a tobacco sifting or classifying device 44. The outer side of the belt conveyor 43 is preferably formed by a profiled layer of rubber or other material which can transport the particles of the tobacco carpet with a minimum of slippage or without any slippage at all. The curtain of air jets extends transversely of the trajectories of tobacco particles which are propelled beyond the pulley 42 whereby such curtain deflects the lighter particles of tobacco but permits the heavier particles (such as fragments of ribs, birds' eyes and the like) to penetrate therethrough and to accumulate in an intercepting receptacle 49 whose bottom wall is disposed below a continuously or intermittently driven feed screw 51 serving to evacuate the heavier particles from the cigarette rod making machine. The velocity of air which forms the jets is selected in such a way that the jets do not appreciably alter the trajectories of the heavier tobacco particles but that they can deflect all desirable particles (primarily tobacco shreds) into a downwardly extending tubular conveyor 52. The lower end of the conveyor 52 discharges the relatively wide stream of tobacco particles which are deflected by the air curtain of the classifying device 44 into the lower end of an upwardly extending second tubular conveyor 53 shown in greater detail in FIGS. 2, 3, 4 and 5. The manner in which the conveyors 52 and 53 are connected to each other is disclosed, for example, in commonly owned U.S. Pat. No. 4,155,367 granted May 22, 1979 to Willy Rudszinat et al.

Figure 5:
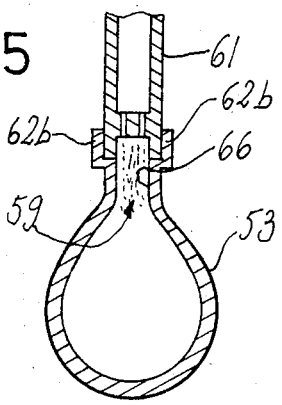
FIG. 5 is a fragmentary sectional view as seen in the direction of arrows from the line V—V of FIG. 2.

The conveyor 53 includes an arcuate portion 56 which is disposed opposite a substantially vertical wall 62 having at its upper end an edge face 64 adjacent to the peripheral surface of a rotary drum- or wheel-shaped suction conveyor 61. The peripheral surface of the conveyor 61 is formed with a series of circumferentially extending recesses or pockets 58 each of which serves to accumulate a discrete elongated batch 59 of tobacco particles. The edge face 64 of the wall 62 of the conveyor 53 is located at a transfer station 63 where successive increments of a relatively narrow stream 86 of tobacco particles are propelled into successive recesses 58 to form discrete batches 59 of tobacco particles. The wall 62 extends substantially or exactly radially of the conveyor 61 and has a substantially horizontal extension **62*a* adjacent to the peripheral surface of the conveyor 61. The latter is driven at a preferably variable speed in a counterclockwise direction as indicated by the arrow 57. As can be seen in FIG. 5, the extension 62*a* comprises a pair of cheeks 62*b* which are adjacent to the respective end faces of the conveyor 61 at the transfer station 63**.

Figure 4:
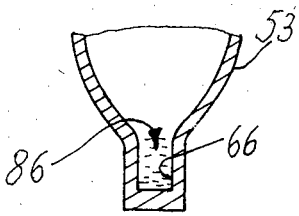
FIG. 4 is a fragmentary horizontal sectional view as seen in the direction of arrows from the line IV—IV of FIG. 2.
Figure 3:
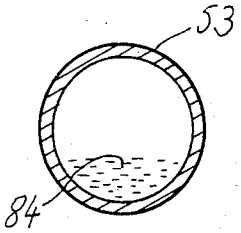
FIG. 3 is a sectional view as seen in the direction of arrows from the line III—III of FIG. 2.

The wall 62 merges gradually into the cylindrical lower portion (see FIG. 3) of the conveyor 53 and its width decreases gradually in a direction toward the peripheral surface of the conveyor 61. FIGS. 4 and 5 show that the wall 62 defines a relatively narrow tobacco channel 66 for the tobacco stream 86 whose increments are propelled beyond the edge face 64 and into the recess 58 which happens to be located at the transfer station 63. The relatively wide tobacco stream 84 which is received from the conveyor 52 is shown in FIG. 3; this stream is converted into the narrower stream 86 on entry of its particles into the channel 66 of the wall 62. The width of the channel 66, at least at the transfer station 63, equals or approximates the width of the recesses 58. The extension **62*a* of the wall 62 is in sealing engagement with the adjacent surfaces of the wheel-shaped suction conveyor 61 through a distance (as considered in the circumferential direction of the conveyor 61) which at least matches or slightly exceeds the length of a recess 58**.

Figure 2:
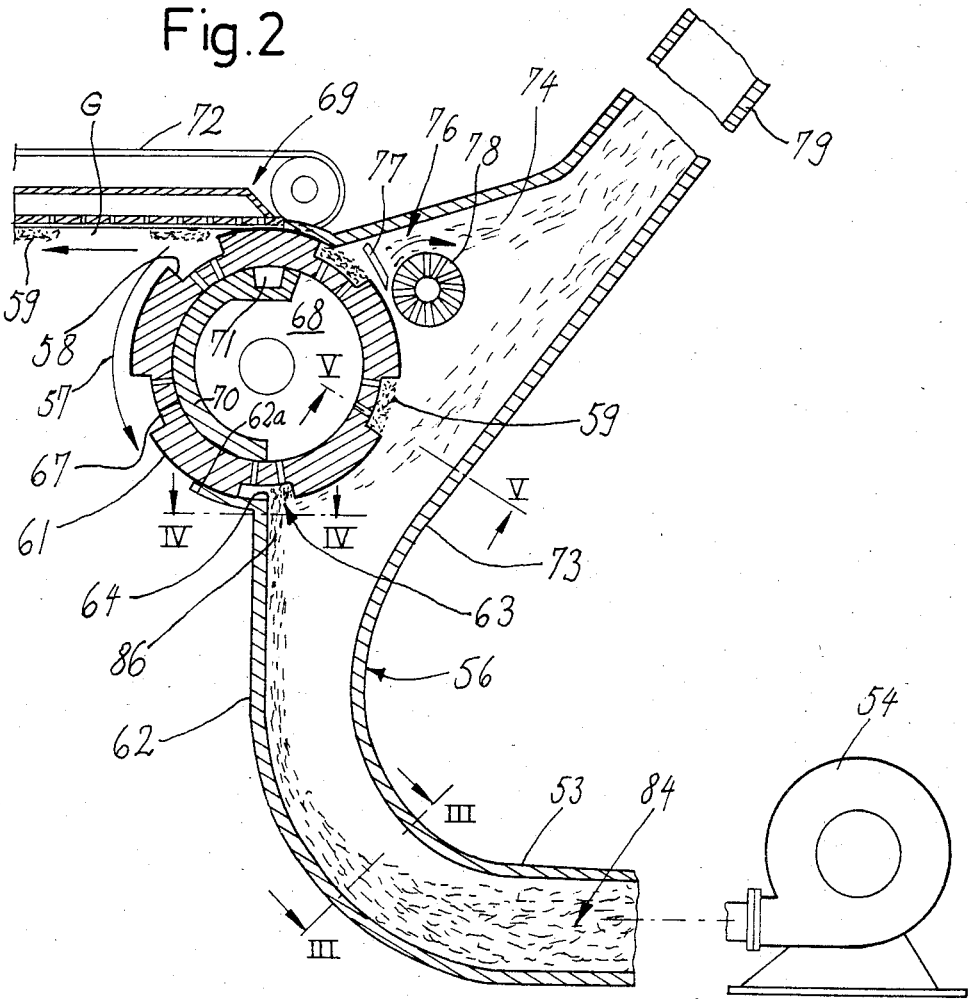
FIG. 2 is an enlarged transverse vertical sectional view as seen in the direction of arrows from the line II—II of FIG. 1.

A portion of the conveyor 61 extends into a central or median portion 73 of the conveyor 53; such median portion is disposed at a level above the arcuate portion 56 and further accommodates the components of a surplus removing or trimming device 76 including one or more stationary knives 77 and a rotary brush 78 which is driven at a constant speed to rotate in a clockwise direction, as viewed in FIG. 2. The purpose of the trimming device 76 is to remove the surplus 74 of tobacco particles from the batches 59 in successive recesses 58 of the conveyor 61.

The conveyor 61 surrounds a stationary suction chamber 68 and those portions of this conveyor which are inwardly adjacent to the recesses 58 are formed with suction ports 67 serving to connect the respective recesses with the suction chamber 68 during travel of these recesses along an arc of substantially 170° (approximately from the one o'clock to the six o'clock position of the conveyor 61). The remainder of the internal surface of the conveyor 61 (which is preferably rotatable about a horizontal axis) is adjacent to a stationary sealing member 70 having an external channel 71 which is disposed at the twelve o'clock position of the conveyor 61 and is connected to the atmosphere or to a source of compressed air (preferably to a source of air whose pressure only slightly exceeds atmospheric pressure). The purpose of the channel 71 is to facilitate or promote the transfer of successive trimmed batches 59 from the respective recesses 58 to the underside of the lower reach of an air-permeable endless belt conveyor 72. The lower reach of this conveyor is adjacent to the bottom wall of a stationary suction chamber 69 which attracts successive batches 59 to the conveyor 72 so that the batches form an interrupted stream or file of compacted tobacco particles. Such stream can be converted into the core of a composite tobacco filler in a manner as disclosed, for example, in the aforementioned commonly owned copending patent application Ser. No. 572,564 of Wahle et al. If the pressure in the channel 71 exceeds atmospheric pressure, compressed air in such channel assists the suction chamber 69 in transferring successive batches 59 from the respective recesses 58 of the rotary conveyor 61 to the underside of the lower reach of the conveyor 72.

The cheeks **62*b* of the wall 62 are adjacent to the end faces of the conveyor 61 between the six o'clock and one o'clock positions of the conveyor 61 to thus ensure that the current of compressed air which is admitted into the lower portion of the conveyor 53 by the outlet of a blower 54 or another suitable source of compressed air cannot escape into the surrounding atmosphere but is compelled to flow along the periphery of that portion of the conveyor 61 which extends into the median portion 73 of the conveyor 53. The conveyor 53 extends past and beyond the conveyor 61 and delivers the current of compressed air, the particles of tobacco which failed to enter a recess 58 at the transfer station 63, as well as the particles of discard tobacco 74 which are removed by the trimming device 76, into a conduit 79 serving to return such tobacco particles into the distributor, e.g., into the magazine 9. The discharge end of the conduit 79 delivers tobacco particles into a collecting device 81 which is adjacent to the gate 14 and includes an air separator 82 as well as a cell wheel 83** which returns the segregated tobacco particles into one of the magazines.

Many details of the distributor which is shown in FIG. 1 are further disclosed and claimed in commonly owned U.S. Pat. No. 4,185,644 granted Jan. 29, 1980 to Uwe Heitmann et al.

The operation of the structure which is shown in FIGS. 1 to 5 is as follows:

The pockets 4 of the conveyor 6 draw particles of tobacco from the magazines 17 and 2 and their contents are thereupon equalized by the straps 23 of the paddle wheel 24. The contents of successive pockets 4 are dumped into the duct 28 whereby the magnetic roller 32 collects metallic particles (if any) which happen to be present in the batches of tobacco particles descending between the guide wall 29 and the upper portion of the downwardly moving reach of the conveyor 6.

The carded conveyor 37 cooperates with the picker roller 39 to form on the upper reach of the belt conveyor 43 an at least substantially uniform tobacco carpet which is propelled beyond the pulley 42 so that the heavier particles of tobacco penentrate the air curtain of the classifying device 44 whereas the remaining particles enter and descend in the tubular conveyor 52. The air curtain, consisting of jets which issue from the row of openings 48 in the plenum chamber 49, does not appreciably alter the trajectories of the heavier tobacco particles but such curtain changes the trajectories of the lighter tobacco particles by 90° and compels the lighter particles to enter the conveyor 52 whence they enter the lower end portion of the conveyor 53. Such particles are thereupon advanced by the current of air which issues from the blower 54 to form the relatively wide first stream 84 which is thereupon converted into the narrower stream 86 on entry of tobacco particles into the channel 66 of the wall 62. This wall can be said to define an elongated path a first portion of which confines the particles of the stream 84 and the second portion of which confines the particles of the stream 86 and directs such particles toward the edge face 64 at the transfer station 63. The current of air which issues from the blower 54 and the particles which form the streams 84, 86 closely follow the inner side of the wall 62, and the current of air propels the particles beyond the edge face 64 so that such particles are compelled to enter the recess 58 at the transfer station and to fill each and every corner of such recess with a surprisingly high degree of predictability. The fibrous material which enters the recesses 58 is compacted under the action of the suction chamber 68 in the conveyor 61 so that the density of each batch 59 is the same and that the density in each and every portion of each and every recess 58 is also the same (or deviates only slightly from an optimum value). The current of air continues to flow in the conveyor 53 and thereby propels toward the conduit 79 all such particles of tobacco which cannot enter a recess 58 at the transfer station 63. Moreover, the current of air cleans the peripheral surface of the conveyor 61 between neighboring recesses 58 from the six to the one o'clock position of the conveyor 61. Still further, the current of air entrains into the conduit 79 all particles of discard tobacco 74 which are removed as excess from successive batches 59 advancing past the trimming device 76 in the interior of the conveyor 53. The particles which failed to enter the recesses 58 and the particles of discard (short) tobacco are recirculated into the conveyor 53 by way of the air segregating device 82, cell wheel 83, one of the magazines 1, 9, 17, conveyor 6, duct 28, conveyor 37, picker roller 59, conveyor 43 and conveyor 52.

Successive trimmed or equalized batches 59 leave their respective recesses 58 under the influence of compressed air in the channel 71 and/or under the influence of subatmospheric pressure in the suction chamber 69 and are transported by the lower reach of the conveyor 72 toward the station where the file of such batches is converted into the core of a composite tobacco filler. The purpose of gaps G between the batches 59 at the underside of the lower reach of the conveyor 72 is to permit introduction of tobacco particles of another type so that the batches 59 are completely concealed when they constitute the cores of fillers of discrete plain cigarettes, cigarillos, cigars or other rod-shaped smokers' articles.

The conveyor 53 can be replaced with other types of conveyors (e.g., rotary brushes or other types of mechanical conveyors) which can transport successive increments of the narrow tobacco stream 86 into successive recesses 58 of the rotating conveyor 61. However, it has been found that the advancing of tobacco particles by pneumatic means in a manner as shown in FIG. 2 ensures a surprisingly gentle treatment of tobacco particles. The current of compressed air which issues from the blower 54 does not comminute the particles of tobacco on their way toward and beyond the edge face 64 of the wall 62, and such current can impart to the particles of tobacco a speed which suffices to ensure predictable filling of each and every portion of the recess 58 which travels past the transfer station 63. The rate at which the conveyor 52 delivers tobacco particles to the conveyor 53 preferably exceeds that rate which is necessary to fill the recesses 58 of the conveyor 61. This ensures that each recess 58 is overfilled and that the dimensions of each of the batches 59 which are transferred onto the conveyor 72 are the same due to the provision of the trimming device 76. The wall 62 and its edge face 64 actually aim tobacco particles into successive portions of the recess 58 which advances past the transfer station 63 with attendant predictable and highly satisfactory filling of each recess, i.e., with attendant formation of batches 59 which can be assembled into a high-quality core. The feature that the wall 62 includes an arcuate portion in the region where the stream 84 is converted into the narrower stream 86 also contributes to more predictable formation of a homogeneous stream 86, absence of clogging of the channel 66 and the formation of highly satisfactory batches 59.

The feature that the conveyor 53 extends along a portion of and beyond the conveyor 61 ensures that the gaseous fluid which issues from the blower 54 does not clog the median portion 73 of the conveyor 53 as well as that all particles of tobacco which cannot enter the recesses 58 and/or which are removed from successive batches 59 by the trimming device 76 cannot clog the conveyor 53 but advance into and in the conduit 79 to be recirculated into the conveyor 53.

An important advantage of the improved method and apparatus is that the particles of tobacco which are about to form successive batches 59 are treated prior to reaching the conveyor 61 so that they are hignly likely to form batches which exhibit a number of desirable characteristics (particularly as regards their density and dimensions). This contributes to the formation of a more satisfactory core in a composite filler and to the making of more satisfactory rod-shaped smokers' articles. Thus, the mass which enters the conveyor 53 is already relieved of heavier particles and the particles of such mass are thereupon accelerated, guided and propelled with a view to fill successive recesses 58 of the rotating conveyor 61 with a heretofore unmatched degree of predictability and reproducibility. Moreover, the improved method and apparatus allow for the making of a composite core at a rate which is required in a high-speed cigarette rod making or an analogous machine. The quality of the core is satisfactory even if its batches are formed at a rate which is needed to form up to and in excess of 8000 cigarettes per minute.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of forming discrete batches of tobacco particles at the periphery of a rotating conveyor, comprising the steps of converting the particles into a first stream and forcibly advancing the stream along a first portion of a predetermined path; converting the first stream into a narrower second stream and forcibly advancing the second stream along a second portion of said path; and conveying successive increments of the second stream toward the periphery and substantially radially of the conveyor.

2. The method of claim 1, wherein at least one of said advancing steps comprises pneumatically transporting the respective stream along the respective portion of said path.

3. The method of claim 1 of forming discrete batches of tobacco particles in the circumferentially extending recesses at the periphery of the rotary conveyor, wherein said conveying step includes propelling successive increments of the second stream into successive recesses of the rotating conveyor so that each recess is at least nearly filled with tobacco particles and its shape determines the configuration of the respective batch.

4. The method of claim 3, wherein said propelling step includes overfilling the recesses of the rotating conveyor with tobacco particles so that each freshly formed batch contains a surplus of tobacco particles.

5. The method of claim 1, wherein at least one portion of said path has an arcuate shape.

6. The method of claim 1, wherein at least said second advancing step comprises introducing the particles of the second stream into a current of air and further comprising the step of conveying the current of air past and beyond the location of impingement of successive increments of the second stream upon the conveyor.

7. The method of claim 6, wherein said second advancing step includes delivering tobacco particles in excess of the requirements of successive batches and further comprising the step of removing the excess in said current of air.

8. The method of claim 6, wherein at least some of the batches contain a surplus of tobacco particles and further comprising the steps of removing the surplus from the respective batches and introducing such surplus into said current of air.

9. Apparatus for forming discrete batches of tobacco particles, comprising a rotary conveyor having a peripheral surface provided with distinct recesses for tobacco particles, said recesses being separate from each other; and means for delivering tobacco particles to said conveyor, including a tubular second conveyor having a particle-guiding wall extending substantially radially and toward the peripheral surface of said rotary conveyor.

10. The apparatus of claim 9, wherein said wall includes a portion which is adjacent to said rotary conveyor and defines a U-shaped channel for a relatively narrow stream of tobacco particles.

11. The apparatus of claim 10, wherein each of said recesses has a predetermined width and said channel has a width which matches or approximates the width of said recesses.

12. The apparatus of claim 9, wherein said second conveyor includes an arcuate portion which is disposed opposite said wall.

13. The apparatus of claim 12, wherein said rotary conveyor has a portion which extends into said second conveyor in the general area of said arcuate portion.

14. The apparatus of claim 9, wherein said second conveyor includes a portion extending beyond said wall and along a portion of the periphery of said rotary conveyor.

15. The apparatus of claim 9, wherein said second conveyor is arranged to deliver tobacco particles with a surplus so that at least some of the batches which are formed in said recesses as a result of admission of tobacco particles thereinto contain excess tobacco, and further comprising means for removing such excess, said excess removing means being disposed in the interior of said second conveyor.

16. The apparatus of claim 9, further comprising a stationary suction chamber, said recesses surrounding said suction chamber and said rotary conveyor having ports connecting said suction chamber with said recesses along a predetermined portion of the periphery of said rotary conveyor.

17. The apparatus of claim 9, wherein said wall has an edge face adjacent to the peripheral surface of said rotary conveyor and further comprising means for admitting into said second conveyor a current of compressed air in a direction to propel tobacco particles beyond said edge face and into successive recesses of said rotary conveyor.

18. The apparatus of claim 17, wherein said second conveyor comprises an enlarged median portion and said rotary conveyor includes a portion which extends into the median portion of said second conveyor.

19. The apparatus of claim 9, further comprising means for removing batches from successive recesses of said rotary conveyor.

20. The apparatus of claim 9, wherein said second conveyor is arranged to deliver tobacco particles at a rate such that successive recesses of the rotary conveyor are overfilled with tobacco particles and further comprising means for removing the surplus of tobacco particles from successive batches in the recesses of said rotary conveyor and means for recirculating the removed surplus into the second conveyor.

* * * * *